US005704079A

United States Patent [19]

Desnoyers

[11] Patent Number: 5,704,079

[45] Date of Patent: Jan. 6, 1998

[54] BATHS HAVING DISPLACEMENTS OF FLUID JETS IN A STRAIGHT LINE

[76] Inventor: René Desnoyers, 1495 Coubertin, Boisbriand Qc, Canada, J7G 2W2

[21] Appl. No.: 573,424

[22] Filed: Dec. 15, 1995

Related U.S. Application Data

[63] Continuation-in-part of Ser. No. 359,026, Dec. 19, 1994, abandoned.

[51] Int. Cl.[6] ..... A61H 33/02

[52] U.S. Cl. ..... 4/541.6

[58] Field of Search ..... 4/492, 541.1, 541.3, 4/541.4, 541.5, 541.6, 605, 615

[56] References Cited

U.S. PATENT DOCUMENTS

| | | | |
|---|---|---|---|
| 4,339,833 | 7/1982 | Mandell | 4/541.6 |
| 4,523,340 | 6/1985 | Watkins | 4/541.4 |
| 4,764,999 | 8/1988 | Rushing | 4/541.6 |
| 4,920,588 | 5/1990 | Watkins | 4/541.6 |
| 4,964,399 | 10/1990 | Faimali | 4/615 X |
| 5,035,010 | 7/1991 | Sakamoto et al. | 4/605 X |

*Primary Examiner*—Robert M. Fetsuga
*Attorney, Agent, or Firm*—Antoine H. Gauvin

[57] ABSTRACT

A bath which has walls making a bottom and sides upwardly extending therefrom. At least one pair of injectors are either continuously mechanically reciprocating or sequentially actuated in a straight line so that fluid jets be moving in order to obtain jets repeatedly continuously displaced as straight lines, along one of these walls being perforated. This bath aims at body treatments, for instance overcoming body pains, particularly the self-relief of aching back. A method is also described for a bath having fluid injectors equally and symmetrically disposed about a median, in two rows, each row being parallel to the median, adjacent to, but short thereof, and parallel to the wall with the longitudinal opening, with the fluid injectors producing uniform fluid jets on each of the two rows, each jet having a uniform trajectory, displacing the trajectory from fluid jets, along two straight lines running across the trajectory, while maintaining spacing between the lines within 4.5±1 inches, and repeating that displacement.

12 Claims, 4 Drawing Sheets

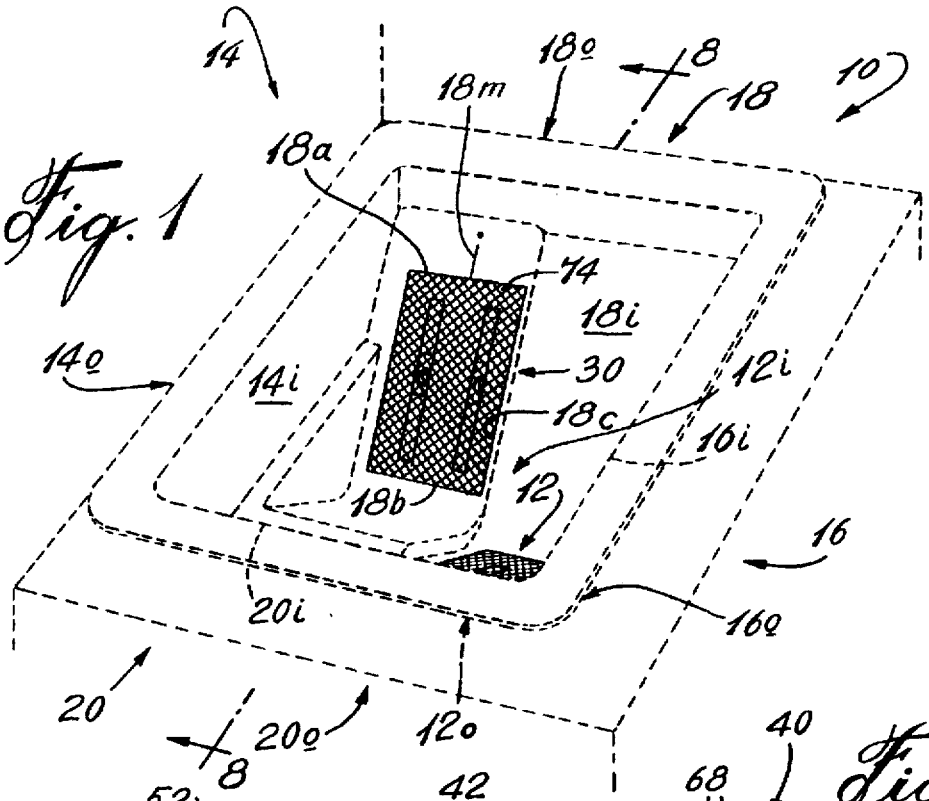
Fig. 1
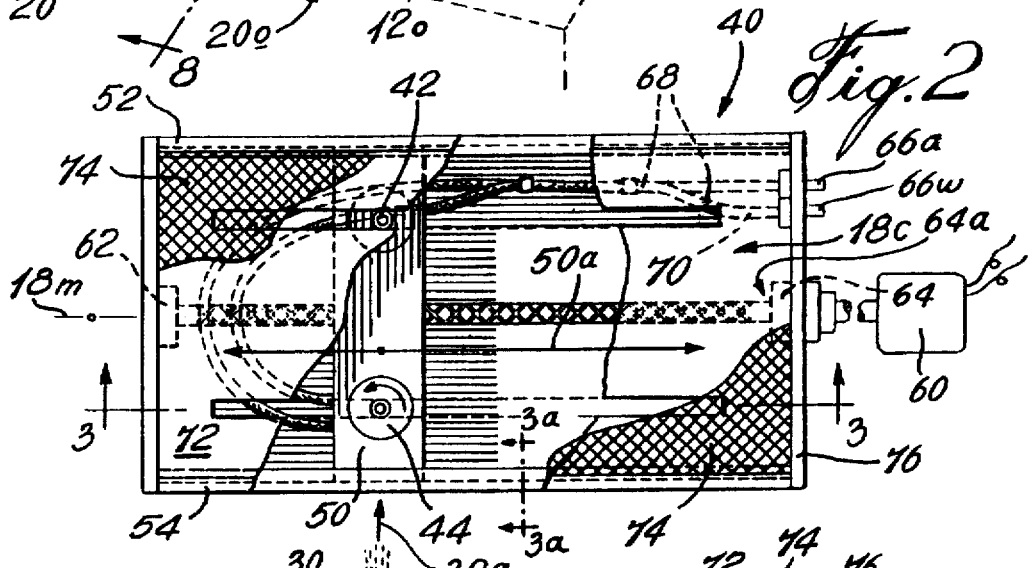
Fig. 2
Fig. 3

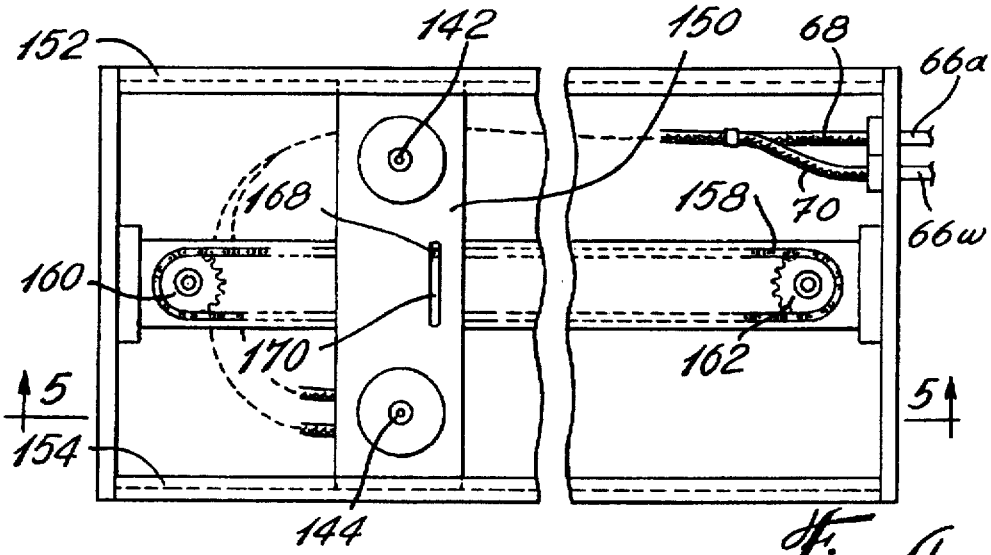
Fig. 4
Fig. 5
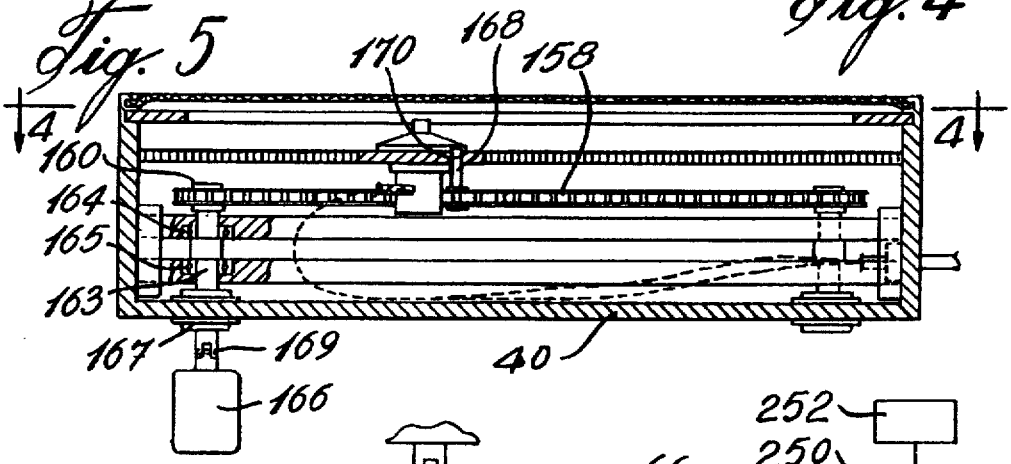
Fig. 6a
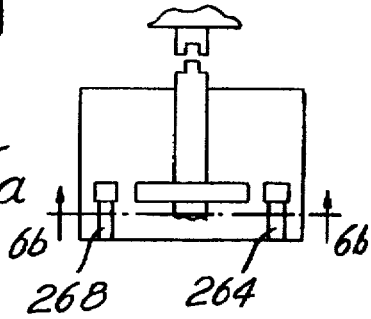
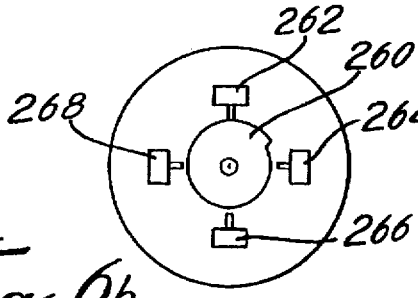
Fig. 6b
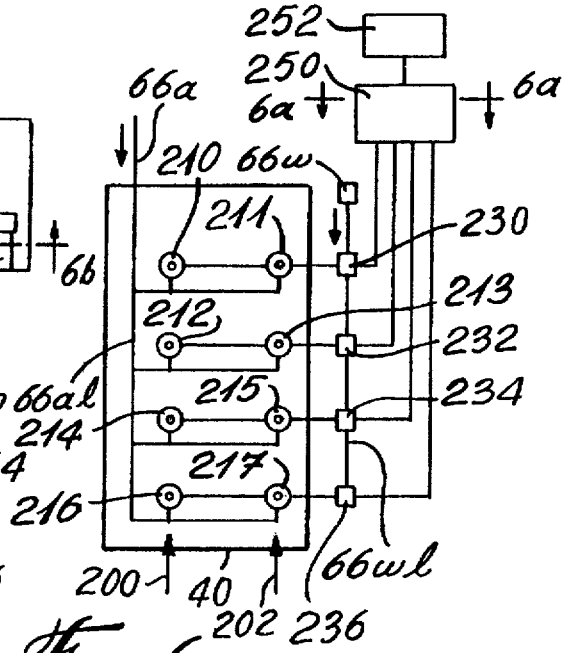
Fig. 6

BATHS HAVING DISPLACEMENTS OF FLUID JETS IN A STRAIGHT LINE

BACKGROUND OF THE INVENTION

1. Field of the Invention

This application is a continuation in part of U.S. application Ser. No. 08/359,026 dated Dec. 12, 1994, abandoned. This invention relates to baths having injectors producing at least two rows of fluid jets being displaced in a straight line in order for each jet to uniformly hit a portion of a human body, and to a method therefor. In a particular embodiment this invention relates to baths to be used at home, where they are movable through doors and corridors found in normal homes, and where bathroom space is limited, such baths delivering from a compact shallow housing, pairs of water jets, obtained from fixed or rotating fluid injectors, said injectors reciprocating or unidirectionally repeating, water jet displacements in a straight line, for self-relief of an aching back: each jet defining a trajectory to impinge at a a point, upon a portion of a human body, and means to displace said trajectory of a fluid jet, said displacement of said trajectory being in a straight line running across said trajectory, in order to obtain a path of uniformly impinging points in a substantially straight line on said body portion. The means to displace said trajectory of a fluid jet, being either a reciprocating carriage on which the injectors are mounted or a water distributor feeding in alternation a number of sets of injectors.

2. Description of Related Art

As far as Applicant is aware, whirlpools also known as whirlpool baths having fluid injectors, are well known to produce a forceful whirling current of water and air, whether hot or not, normally by the introduction of air via a venturi connected into a water line within the injector: the water creates the suction for drawing air into the flow of water. The air widens the jet and softens the impact of the water delivered via fluid injectors or nozzles. Such fluid injectors or nozzles are either fixed or rotating about a fixed point to deliver the water-air mixture. A therapeutic bath makes use of air only, delivered through a salt-shaker-like air nozzle. The term "injector" or "nozzle" is used interchangeably in the trade and both are contemplated in the present application.

Rushing in U.S. Pat. No. 4,764,999 dated Aug. 23, 1988, and Watkins in U.S. Pat. No. 4,920,588 dated May 1, 1990 and in U.S. Pat. No. 4,523,340 dated Jun. 18, 1985 describe a jet sprays moving up and down in an arcuated fashion, thereby producing an uneven pressure on a body receiving such a jet spays. the jet is along a single row.

Sakomoto et al. in U.S. Pat. No. 5,035,010 dated Jul. 30, 1991, describes a shower having a single shower head hydraulically reciprocating.

Mandell in U.S. Pat. No. 4,339,833 dated Jul. 20, 1982 describes a reciprocating hydro-massage apparatus where flexible conduits or hoses 80, 81 are used. However ample space is required, in order to prevent entanglement of these hoses, as shown in FIG. 4 of the Patent. Also as in previous references, only a single head is used in order to deliver a single row of a fluid jet.

Although it may not be a problems in spacious areas such as public areas, hotels, hospitals and the like, it is a problem for normal homes where a bath must be movable through doors and corridors found in normal homes.

Whether in the art of whirlpool, therapeutic, spas, hydromassage and the like, for automatically displacing the trajectory of fluid jets along a straight line: whether mechanically reciprocating or repeating unidirectionally displacing the trajectory of fluid jets along a straight line and yet without reference to the real advantage of at least two rows as for headaches treatments and the ways to shorten the height of a bath, only Mandell's teaching is known.

The expression: "straight line" displacement, or displacing in a "straight line" being used, as opposed to a rotating displacement, encompasses mechanically reciprocating as well as repeating a one way a straight line displacement. The expression: "across" includes displacements from one side to the other side of the trajectory of fluid jets, and not only perpendicular to the trajectory.

SUMMARY OF THE INVENTION

The invention aims at baths and methods for body treatments, for instance overcoming body pains, particularly the self-relief of aching back, and in a particular embodiment, using two rows of uniformly impinging points.

The invention is preferably directed to baths to be used at home, where bathroom space is limited, such baths delivering pairs of water jets, obtained from fixed or rotating fluid injectors, from a compact shallow housing: for instance being about 8 inches deep.

The invention is directed to a bath comprising:

walls defining a bottom and sides upwardly extending therefrom, each of said walls having an inner surface and an outer surface, and said walls cooperating to define a receptacle for water and a person, a longitudinal opening in one of said walls, in order to communicate between the inner surface and the outer surface of one of said walls, said opening being defined by longitudinal sides, said longitudinal sides extending from one end to an opposite end, at least one pair of fluid injectors, each injector producing a fluid jet defining a trajectory in a straight line to impinge at a point, upon a portion of a human body, said injectors being mounted on a carriage, and defining at least one row, said row being across said longitudinal opening, said carriage being provided with a motorized means to mechanically reciprocate said carriage, for displacement of said carriage and thereby said injectors, and thus said trajectory from each fluid jet in a straight line, running across said trajectory, and along said longitudinal opening from said one end to said opposite end of said longitudinal opening, for allowing impinging fluid from each of said injectors, via said longitudinal opening and towards said bath, in order to obtain a path of impinging points in a substantially straight line on said body portion, and to continuously repeat said displacement in a straight line, and a housing to confine said injectors, said carriage and partly said motorized means to mechanically reciprocate said carriage, said housing being behind said longitudinal opening and water-tight sealed to said outer surface of said walls, said carriage having opposite end, said opposite ends of said carriage being substantially parallel to, said longitudinal sides of said longitudinal opening, said opposite ends of said carriage being slidably mounted into said housing, for mechanically reciprocating said fluid injectors along said longitudinal opening, whereby each of said injectors delivers one fluid jet which is repeatedly continuously displaced as a straight line along said longitudinal opening to impinge upon the body of a person in said bath near said longitudinal opening.

To confine "partly" said motorized means, means that the motor as such and connections therewith are generally outside the housing, as will be evidenced herein below with reference to the drawings.

The invention is also directed to such a bath having only two fluid injectors, said injectors delivering a water jet containing air, said air being pumped into said injectors, via a flexible hose, and said water being fed into said injectors via another flexible hose, said hoses having one end and another end, said hoses running along one longitudinal side of the longitudinal opening, from one end to the opposite end of the longitudinal opening, one of the ends of these hoses linking the injectors, being rotatably mounted near the other longitudinal side of the longitudinal opening, in order to obtain a 360° rotation hose-injector coupling, and for these hoses to define a curve between said hose-injector coupling, and said one longitudinal side of the of the longitudinal opening, and the other ends of these hoses being fixedly mounted adjacent to said opposite end of said longitudinal opening, and superimposed and fixedly held together near said other ends of these hoses, for a distance of about half the length of the longitudinal opening.

The invention is also directed to a bath comprising:

walls defining a bottom and sides upwardly extending therefrom, each of said walls having an inner surface and an outer surface, and said walls cooperating to define a receptacle for water and at least one person, a longitudinal opening in one of said walls, in order to communicate between the inner surface and the outer surface of one of said walls, said opening being defined by longitudinal sides, said longitudinal sides extending from one end to an opposite end, at least two rows of fixedly mounted fluid injectors, said row being oriented along said longitudinal opening, each injector producing a fluid jet defining a trajectory in a straight line through the longitudinal opening in one of said walls, to impinge at a point, upon a portion of a human body, in one row, the injector nearest to the injector of the adjacent rows forming together, a set, each set of fluid injectors being connected to a water distributor delivering in alternation water to one of the sets of injectors, for each set of injectors, one from each row, said set of injectors upon actuation of said water distributor producing a unidirectional displacement of a set of flows from said set of injectors, along a set of straight lines, along said longitudinal opening, thereby producing a means to displace said fluid jets defining a trajectory, and thus obtaining a straight line trajectory from a row of fluid jets, running sequentially along said longitudinal opening from said one end to said opposite end of said longitudinal opening, for allowing impinging fluid from each of said injectors, via said longitudinal opening and towards said bath, in order to obtain a path of impinging points in substantially straight lines on said portion of a human body, and to continuously unidirectionally repeat said displacement of flows in straight lines, and a housing to confine said injectors, said housing being behind said longitudinal opening and water-tight sealed to said outer surface of said walls.

The trajectory of the fluid jets may be continuous or discontinuous as will be described herein below.

The invention is also directed to such baths wherein the wall of the bath having a longitudinal opening, is an inclined wall, and said inclined wall of the bath, defines a seating place with a longitudinal median, and symmetrically disposed about said longitudinal median, said longitudinal opening extending on each side of said median, along said inclined wall of the bath, each injector of said a pair of fluid injectors, being symmetrically disposed about said longitudinal median, one on each side of said median, and said carriage or water distributor, displacing said fluid jet on each side of said median, substantially parallel to said median and to said inclined wall, for said water from said water jets to preferentially hit on each side of said median and nearby said median, and thereby cooperating in a short height bath.

The invention is also directed to a method, in a bath selected from the group consisting of whirlpool and therapeutic baths, which comprises:

in a bath having walls defining a bottom and sides upwardly extending therefrom, each of said walls having an inner surface and an outer surface, and said walls cooperating to define a receptacle for water and at least one person, a longitudinal opening in one of said walls, in order to communicate between the inner surface and the outer surface of one of said walls, said opening being defined by longitudinal sides, said longitudinal sides extending from one end to an opposite end, and fluid injectors equally and symmetrically disposed about a median, in two rows, each row being parallel to said median, adjacent to, but short thereof, and parallel to said wall having said longitudinal opening, with said fluid injectors producing uniform fluid jets on each of said two rows, each jet having a uniform trajectory, displacing said trajectory from said fluid jets, along two straight lines running across said trajectory, while maintaining spacing between said lines within 4.5±1 inches, in order to obtain a path of uniform impinging points in two substantially straight lines on a human body portion, and continuously repeating said displacement in said two straight lines.

Further embodiments of the invention will be described herein below.

DESCRIPTION OF THE DRAWINGS

In the drawings which illustrate some of the preferred ways of carrying out the invention, FIG. 1 is a perspective view of a bath, for instance a whirlpool, having water jets mechanically reciprocating in a straight line;

FIG. 2 is a top view of the water jets, taken along line 2—2 of FIG. 3, but with the grid or netting, and the cover, partly removed;

FIG. 3 is an elevation view taken along line 3—3 of FIG. 2;

FIG. 4 is a face view of another water jet mechanically reciprocating in a straight line, taken along line 4—4 of FIG. 5;

FIG. 5 is an elevation view taken along line 5—5 of FIG. 4;

FIG. 6 is a schematic view of another way of displacing the trajectory of a fluid jet, in a straight line running across said trajectory using an electric selector as an alternating distributor;

FIG. 6*a* is a cross-section view, taken along line 6*a*—6*a* of FIG. 6, of one of the ways to displace the trajectory of a fluid jet, in a straight line running across said trajectory and along said longitudinal opening;

FIG. 6*b* is a face view taken along line 6*b*—6*b* of FIG. 6*a;*

DESCRIPTION OF SOME OF THE PREFERRED WAYS OF CARRYING OUT THE INVENTION

As shown in FIG. 1, briefly stated the bath 10, which is preferably a whirlpool where air enters by suction via a venturi connected into a water line leading to a fluid injector, but as desired, may also be a therapeutic bath which makes use of air only, delivered through a salt like nozzle, or other bath delivering a fluid, comprises:

walls defining a bottom 12 and sides 14, 16, 18, 20 upwardly extending therefrom. The number of sides is immaterial as long as the sides cooperate to define a receptacle for containing water and at least one person: The bath in a preferred embodiment is rectangular, but it may be polygonal and even circular and oval.

Each of the walls has an inner surface such as 12*i*, 14*i*, 16*i*, 18*i*, 20*i* respectively, and an outer surface such as 12*o*, 14*o*, 16*o*, 18*o*, 20*o* respectively.

A longitudinal opening is in one of the walls in order to communicate between the inner surface and the outer surface of the walls, for instance 18*c*. The opening is defined by longitudinal sides, said longitudinal sides and thereby said opening, extend from one end to an opposite end. If desired that opening may be split in two or more openings which is still an opening which has been simply subdivided.

Figure 3A:
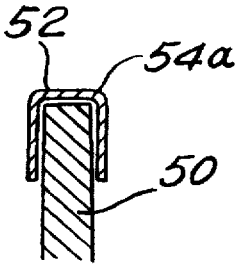
FIG. 3*a*, next to FIG. 7*b*, is a cross-section view taken along line 3*a*—3*a* of FIG. 2.

The bath comprises at least one pair of fluid injectors, for instance 42, 44 each injector producing a fluid jet, such as 30 of FIG. 3, defining a trajectory in a straight line to impinge at a point, upon a portion of a human body.

These injectors may be fixed such as 42 or rotating about a fixed point such as 44. The rotating injectors have better performance, since massage is obtained on a much greater body area.

These injectors may be mounted in a single row on a mechanically reciprocating carriage, for instance carriage 50, said row being across said longitudinal opening.

As shown in FIGS. 1–3, and 3*a* the carriage is slidably mounted: for instance by rails 52, 54: For example with rails 52, 54 having a U-shaped cross-section, and thereby defining an opening, whereby the openings of the U-shaped cross-section of the rails are face-to-face oriented, for each rail to slidably hold there between the carriage 50: Opposite ends of the carriage, adjacent to the housing, and along the longitudinal sides of the longitudinal opening, being within the opening of one of the U-shaped cross-section of one of the rails 52, 54 mounted onto a housing 40 underneath one of walls defining the bottom and sides, and having a longitudinal opening, for mechanically reciprocating, as shown by the arrows 50*a*, the fluid injector along said longitudinal opening, for instance 18*c* of the wall 18.

The housing, for instance housing 40, as defined throughout the specification including the claims, for the injectors and other components referred therefor, may be integral with the bath, that is molded with the bath when the bath is made, or added to the bath but water-tight sealed to the outer surface of one of the walls making the bath, for example sealed to said outer surface 18*o* of wall 18.

There are several ways or motorized means or devices to mechanically reciprocate the carriage. In one of the ways, the carriage has mounted thereon a ring 56, and that ring has mounted therein a projecting finger 57. A motorized twin-helix crisscross screw 58 (in FIG. 3, the helices along that screw being partly shown) is rotatably mounted for rotating inside the ring 56 and for engaging the finger 57, in order to mechanically reciprocate the carriage 50, with a motor 60 outside said housing, and bearings 62, 64 and seals, such as seal 64*a* for bearing 64, for water-tight sealing engagement of the crisscross screw 58 through the housing 40, whereby the carriage is driven along said longitudinal opening in one direction with one of the helices of the screw 58 and contrary thereto by the other helix.

Figure 8:
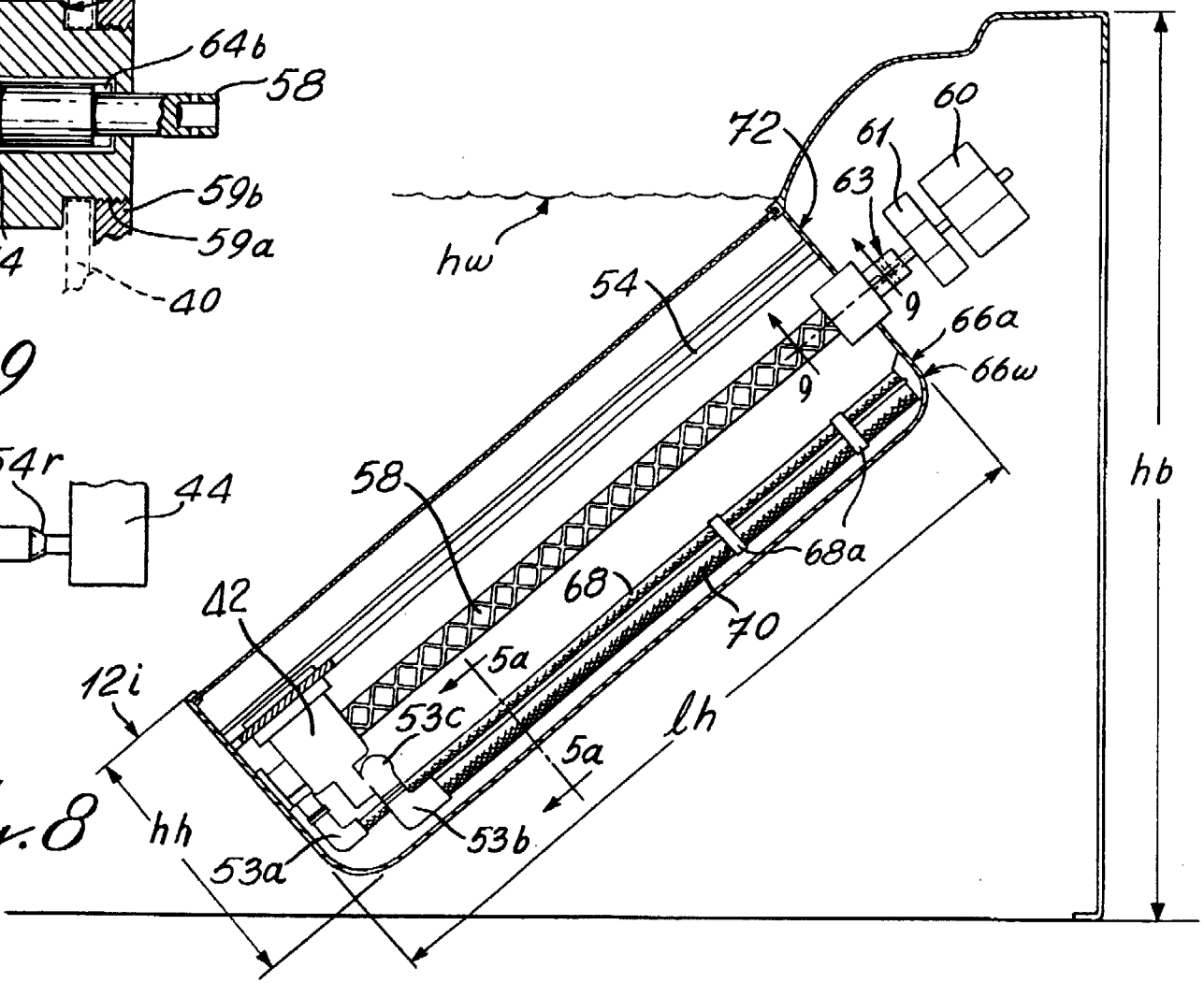
FIG. 8 a cross-section view, taken along line 8—8 of FIG. 1, illustrating the shallow housing for the injectors, enabling a bath provided therewith to be easily movable in a home.

In a particular embodiment, as shown in FIG. 8 the motor 60 which is 120 volts, 0.45 amperes, is operated via a gearing down box 61, reducing the rotation of the output shaft to 20 R.P.M. The output shaft of the gearing down box 61, is connected to the crisscross screw 58.

Figure 9:
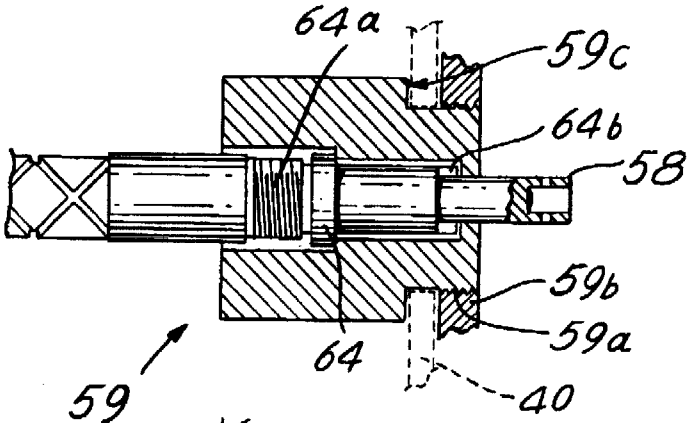
FIG. 9 is a cross-section view taken along line 9—9 of FIG. 8.

As shown in FIGS. 8 and 9, the crisscross screw 58 which is rotatably and water-tight, mounted in a casing 59, is a reducing crisscross screw having after a non-reduced initial portion, a first seat of reduced diameter on which a first seal 64*a* is placed, and a second press-fit bearing 64(*b*) which revolves the crisscross screw 58, and a final diameter reduction defining a journal on which revolves bearing 64*b* which is also press-fit, and ending into a female portion for receiving the output shaft of the gearing down box 61 locked with a kingpin 63. By being water-tight, the crisscross screw 58 enables the water in the pool to exceed or be above the level where the motor is, and thereby cooperating to reduce the height of the baths. The casing 59 is provided with a threaded male end 59*a* and a nut like casing 59*b* to receive the male end 59*a*. The male end 59*a* defines a seat with part of the male end 59*a*, and a shoulder 59*c* to squeeze the wall of the housing 40, between the shoulder 59*c* and the nut like casing 59*b*. In a preferred embodiment that housing is integral with the bath, that is an integral part of the bath.

The fluid injectors, such as 42, 44 are connected to air outlet 66*a*, and water outlet 66*w*, via flexible lines or hoses 68 and 70 respectively, as is known in the art.

Figure 5A:
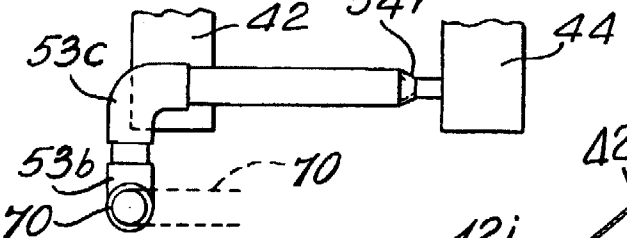
FIG. 5*a*, next to FIG. 8, is a face view taken along line 5*a*—5*a* of FIG. 8.

When two hoses such as 68 and 70 are used in a limited space, they tend to entangle and to kink, causing disruptions. I found that entanglement and kinking are overcome, when two hoses, such as the water hose 68 and air hose 70, are:

running along one longitudinal side of the longitudinal opening, from one end to the opposite end of the opening, as shown in FIG. 2, one of the ends of these hoses 68, 70 linking the injectors, are rotatably mounted to these injectors, on the other longitudinal side of the longitudinal opening, for instance as shown in FIGS. 5*a* and 8, elbow 53*b* being rotatably mounted to elbow 53*c*, and similarly elbow 53*a* to injector 42, in order to obtain a 360° rotation hose-injector coupling, and for these hoses to define a curve between said hose-injector coupling, and the one longitudinal side of the longitudinal opening, and the other ends of these hoses are fixedly mounted to the opposite end of the longitudinal opening, and superimposed and fixedly held together as to be held together for a distance of about roughly half the length of the longitudinal opening, with for instance clasps 68*a* or other fasteners, adjacent to respectively a water and an air source, as shown in FIG. 8.

When two injectors are using the same flexible lines such as hoses 68 and 70, a pressure regulator is generally used, as otherwise, the fluid will have a tendency to favour the injector terminating the path of the flow of fluid: One of the ways to obtain a pressure regulator is to taper the line leading to the injector having a greater pressure in order to equalize the pressure: that is to obtain an equal pressure in the two injectors 42, 44. This may be for instance as shown in FIG. 5*a* at 54*r*, by tapering of the inside diameter of a line interconnecting the injector 42 to the injector 44, for example by reducing the diameter of the line from 1 inch to ⅝ inch, by a 1 inch long taper, prior to reaching injector 44. In some cases, depending upon the nature of the injectors being paired, a pressure regulator is not required.

In a preferred embodiment, the height hh of the housing (FIG. 8), was 8 inches, and the length lh of the housing about 2 feet, for a bath which was 29 inches in height hb, and was easily supported by a holding frame. The slope of the wall 18 reduces the height hb, of the bath, and thereby eases transportation. The seal such as 64*a* of FIG. 9, enables the water level hw to be higher than the motor.

As stated above, the expression: "across" includes displacements from one side to the other side of the trajectory of fluid jets: for instance as shown in FIG. 3, the trajectory is from the bottom to the top at 30 as shown by the arrow 30*a*, and the displacement of the trajectory is somewhat horizontal to that trajectory as shown by the arrows 50*a* of FIG. 2.

The water jet 30, is in the case of whirlpools, fluid injectors producing water jets, and in the case of therapeutic baths, air nozzles producing air jets.

In a preferred embodiment, as shown in FIGS. 1–3, the bath, preferably a whirlpool 10, has one of the walls inclined, for instance 18, and the inclined wall of the bath defines a lounge-chair having a seating place with an inclined back and a longitudinal median, for instance 18*m*, and symmetrically disposed about the longitudinal median, a longitudinal opening 18*c*, extending on each side of the median, along said inclined wall of the bath, and each injector of the pair of fluid injectors, being symmetrically disposed about the longitudinal median 18*m*, one on each side of the median, as for injectors 42, 44, and the carriage displacing, or mechanically reciprocating the water jet on each side of the median, substantially parallel to the median and to said inclined wall 18, for fluid, for instance water from the fluid injectors to preferentially hit on each side of the median, adjacent thereto, but short thereof, in this way the inclined wall cooperating in shortening the height of the bath.

The shortening of the bath is also possible because of the hose arrangement which may be received in a shallow housing 40, as shown in FIG. 8 and because of the water-tight seals joining the housing to the outside: such as seals to water and air lines, and of the shaft to the motor.

The longitudinal opening may be defined as such from the walls of the bath. However, for easy access to the mechanically reciprocating mechanism of the fluid injectors, a cavity leading to the housing 40 of the water mechanically reciprocating jets, is defined from the walls of the bath and a cover 72 is removably mounted on the cavity for fencing the cavity. This cover 72 however, is provided with the longitudinal opening or openings for allowing the impinging water or other fluids, from the fluid jets to hit that portion of a human body. For comfort, on top of the cover 72, a grid or netting 74 may be secured with a frame 76 or otherwise.

When the hoses 68 and 70 are superimposed, as described above in order to avoid entanglement and kinking, the housing 40 may have a height, as measured from the top of the netting 74 to the bottom of the housing 40, not exceeding more than 8 inches. This allows moving baths, being 28 to 30 inches in height, through residential doors and residential corridors, thus generally without encountering moving difficulties.

In a preferred embodiment, the longitudinal opening has a longitudinal median, and the carriage is driven along the longitudinal median: If desired, that median may be falling on the longitudinal median of the side wall 18, but need not be.

In a preferred embodiment, it is these opposite ends of the carriage, adjacent to the housing, that are slidably mounted to the housing, and said at least one fluid pair of fluid injectors, is a one pair: one of said injectors is disposed near one of said opposite ends adjacent to the housing, and the other injector near the other of said opposite ends adjacent to the housing.

In another embodiment, as shown in FIGS. 1, 4 and 5, the longitudinal opening 18*c* has opposite ends, 18*a*, 18*b*. Each fluid jet like 30 of FIG. 3, is obtained from fluid injectors, such as 142, 144, weather fix or rotating about a fix point as described for injectors 42, 44, and mounted on a carriage 150. The fluid injectors are connected with hoses 68, 70 to air outlet 66*a* and water outlet 66*w*, as discussed above to prevent entanglement and kinking of the hoses.

The carriage is slidably mounted between rails 152, 154, unto said housing, underneath said wall having a longitudinal opening, for mechanically reciprocating the fluid injectors along said longitudinal opening from one of said opposite ends to the other as already discussed herein below with rails 52, 54.

A motorized endless chain 158 is turning about two pulleys 160, 162, with a motor 166 joining the pulley 160 via a shaft 163 rotatably mounted on bearings 164, 165, and seals 167, the shaft having a lock pin 169. Thus the motor operates regardless of the level of water in the bath, as already explained above, by having seals 167 making the shaft, water-tight.

One pulley is mounted near one of said opposite ends 18*a*, 18*b*, of said longitudinal opening, and the other pulley is mounted near the other of said opposite ends of said longitudinal opening.

Thus, one of the pulleys has a shaft extending outwardly of the housing, via a water-tight sealing arrangement, and being rotatably mounted to the motor, in order to have a motorized endless chain.

The endless chain has a tongue 168, and the carriage having opposite ends adjacent to the housing, is provided with a slot 170 running crosswise said endless chain for continuous engagement with the tongue 168, whereby the endless chain mechanically drives the carriage in one direction and contrary thereto, upon turning about one of the two pulleys, and thereby mechanically reciprocating the fluid injectors 142, 144 and said water jet.

Thus, said pulleys, said endless chain, said tongue, said motor, and said shaft are said motorized means to mechanically reciprocate said carriage and thereby said fluid injectors.

Thus FIGS. 1–5 illustrate motorized means to mechanically reciprocate the carriage, two means to mechanically displace that trajectory from a pair of fluid jet, in a straight line running across said trajectory and along said longitudinal opening, for allowing impinging fluid from said trajectory, via said longitudinal opening and towards said bath, in order to obtain a path of impinging points in a substantially straight line on a portion of a human body, and to continuously repeat said displacement in a straight line, whereby said fluid jets mechanically reciprocating along said longitudinal opening is to impinge, (preferably uniformly impinge), upon a portion of a human body in said bath, near said longitudinal opening.

Figure 7A:
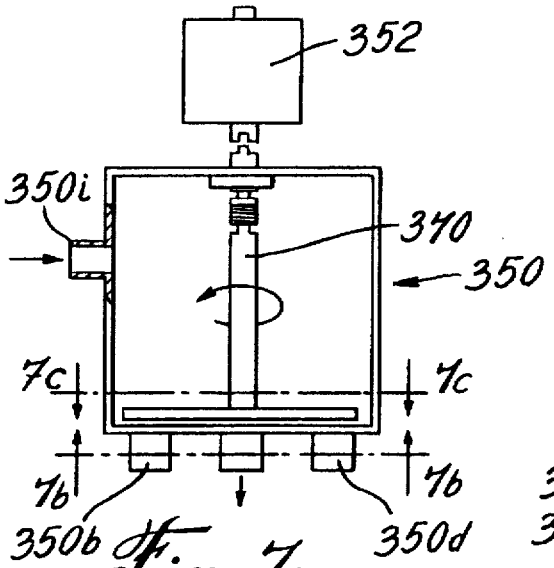
FIG. 7*a* is a cross-section view, taken along line 7*a*—7*a* of FIG. 7.
Figure 7:
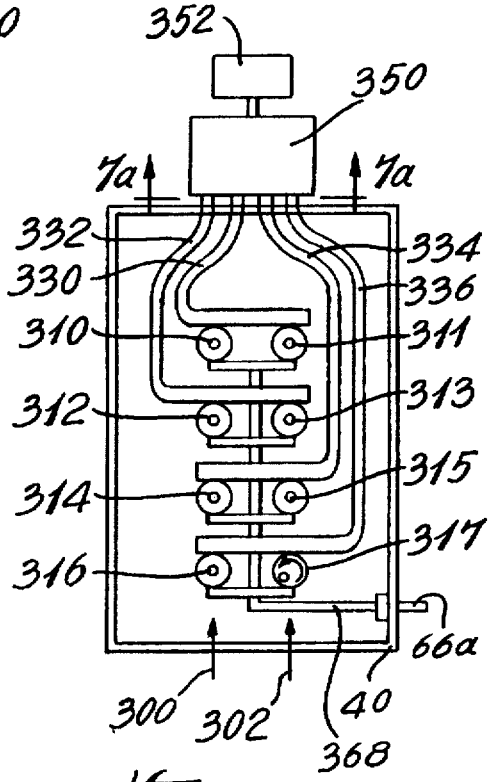
FIG. 7 is a schematic view of another way to displace the trajectory of a fluid jet, in a straight line running across said trajectory and along a longitudinal opening, using another alternating distributor.
Figure 7C:
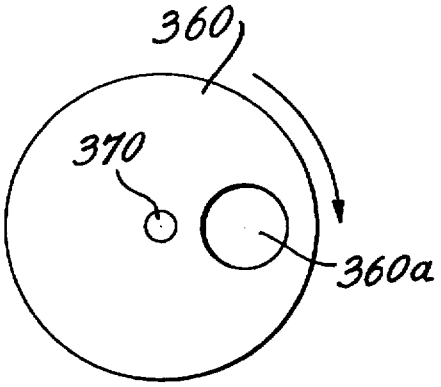
FIG. 7*c* is a cross-section view, taken along line 7*c*—7*c* of FIG. 7*a;*

In another embodiment, as shown in FIGS. 1, 6 and 7, no carriage is needed to displace the water jets. Instead, the wall having a longitudinal opening communicating between the inner surface and the outer surface of said wall of a bath, is provided with at least two rows of fixedly mounted fluid injectors, for instance the two rows 200 and 202 of FIG. 6, and 300, 302 of FIG. 7, the rows are oriented along the longitudinal opening.

Each injector producing a fluid jet, defines a trajectory in a straight line through the longitudinal opening in one of the walls of the bath, to impinge at a point, upon a portion of a human body. In one row, the injector nearest to the injector of the adjacent rows form a set together.

Each set of injectors, (with respect to two rows, it is a pair), is connected to a water distributor delivering in alternation water with one of the sets of injectors.

In one instance the water distributor is:

for each set of valves, an electrically operated water valve, bridging a set of injector to a water source, said valves being operatively connected to an electric distributor cyclically and sequentially directing an electric current to the water valves, in consecutive order to obtain sets of fluid jets, from each successive set of injectors, one from each of said rows, said sets of injectors upon actuation of said valves by said electric distributor, to operate in consecutive order said valves, producing a unidirectional displacement of a set of flows from said injectors, along a set of straight lines, along said longitudinal opening, thereby producing a means to displace said fluid jets defining a trajectory along said longitudinal opening:

In the bath which is preferably a whirlpool as shown in FIG. 6, the walls having a longitudinal opening communicating between the inner surface and the outer surface of the wall, is provided along the longitudinal opening with at two pairs of rows fixedly mounted fluid injectors such as 200, 202 each of said injectors, for instance 210, 212, 214, 216 being connected for instance to an electrically operated water valve 230, 232, 234, 236, said valves being outside the housing 40. Each set, or pair in the case of two, of fluid injectors has an electrically operated water valve.

For each pair of fluid injector, a water line is connecting one valve through the housing 40, to each injector of the pair, and connecting the valve to a water source, The housing confines the injectors, and partly the water lines connecting a valve to a pair of injector, and these water lines are water-tight joint through the housing 40. These valves are operatively connected sequentially in order to obtain said displacement of said trajectory of a fluid jet along one of said rows, for instance 200, 202.

This sequential connection of the valves may be obtained from alternating electric distributors cyclically and sequentially directing a current to the valves:

For instance an electric selector 250 operated with a motor 252 or with a computer program or other well known means to operate sequentially these valves. In the case of the electric selector 250, which is a cam operating micro switches, as shown in FIGS. 6*a*, 6*b* the motor 250 driving a cam 260, may operate a plurality of micro switches, such as 262, 264, 266, 268, sequentially positioned and each being operatively connected to one of the water valves, such as 230, 232, 234, 236, for feeding a current opening the water valves, in order to obtain said displacement of said trajectory from a fluid jet along said longitudinal opening.

Instead the electric selector may give direct contact to terminals of the valves by feeding to these terminals the electric current to movable electric brushes, the brush replacing the cam and the terminals replacing the micro switches, as is known in the art.

With two or more rows such as 200, 202, the water valves are connected to two or more fixedly mounted fluid injectors at a time, one from each row, such as 210, 211; 212, 213; 214, 215; 216, 217.

As already indicated, the expression "a longitudinal opening", throughout the specification that is the disclosure and the claims, encompasses continuous as well as segmented longitudinal openings: To illustrate the point, for example in FIG. 6, the longitudinal opening may be segmented to offer along the row 200, only 4 openings to allow one of the fluid jets as obtained from the fluid injectors such as 210, 212, 214, 216, each to go through one of the 4 openings, the 4 openings thus defining a segmented longitudinal opening, running from the opening for the injector 210 to the injector 216. The same could be said for the row 202 and of additional rows if desired thereby resulting in, an one opening which is segmented in 8 parts.

When air is used with water, an air line 66*al*, is joining the venturi of each injector to an air outlet 66*a*.

As shown in FIG. 7, similar to FIG. 6, in the bath which is preferably a whirlpool the wall having one longitudinal opening, is provided with at least two rows of fixedly mounted fluid injectors such as 300, 302 but each injector, for instance 310, 312, 314, 316 is connected to a water line respectively 330, 332, 334, 336. The water lines are water-tight sealed to the housing 40 as discussed above, and individually connected to a mechanical water distributor cyclically and sequentially feeding water to the water lines in order to obtain said means to displace said trajectory from a fluid jet and thus said straight line along said longitudinal opening.

This sequential connection may be obtained from a closing partition movably mounted inside a mechanical water distributor, said partition having an aperture displaceable to close said water lines, except for the line for which the aperture allows water through: For instance a mechanical water distributor 350, which is motor driven by a motor 352, operates sequentially these fluid lines.

Figure 7B:
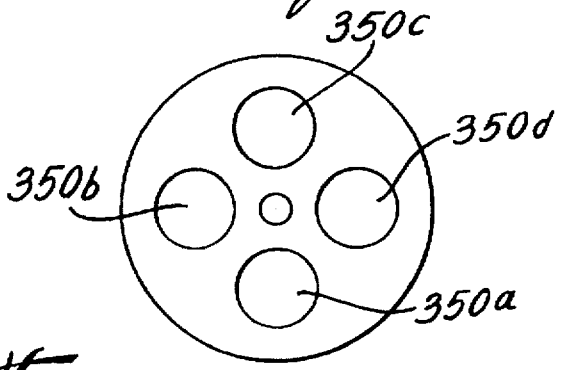
FIG. 7*b* is a cross-section view, taken along line 7*b*—7*b* of FIG. 7*a;*

The mechanical water distributor as shown in FIGS. 7, 7*a* and 7*b*, has a reservoir containing water, and is provided with a plurality of fluid outlets 350*a*, 350*b*, 350*c*, 350*d*, concentrically disposed about a symmetrical axis, and a water outlet 350*i* receiving water. An air line 368 joining the venturi of each injector to an air outlet 66*a*.

A motor-driven, closing partition(for instance, a disk 360) is rotatably mounted along said symmetrical axis, (for instance the motor 352 is connected to a rotatably mounted shaft 370 at one end and to a the closing partition, such as 360, at or near the other end) and having an aperture, such as 360*a*, said aperture is displaceable over said fluid outlets, said closing partition being in tight-fit relation with said fluid outlets for closing them, whereby all fluid outlets are closed by said closing partition except for the portion in contact with the aperture, that portion in contact with said aperture changing with the rotation about said symmetrical axis, of said aperture.

Each injector, for instance 310, 312, 314, 316, is sequentially connected to one of the fluid outlets 350*a*, 350*b*, 350*c*, 350*d*, via their respective fluid lines 330, 332, 334, 336, in order to obtain said displacement of said trajectory from a fluid jet along said longitudinal opening by sequentially actuating said injectors. If two or more rows such as 300, 302, are used, the water valves are connected to two or more fixedly mounted fluid injectors at a time, as desired, such as 310, 311; 312, 313; 314, 315; 316, 317.

It should be borne in mind that the injectors producing these jets may be fixed or rotating as shown for instance at 317 to obtain a spiralling jet. This is true for any injector referred to in the entire application.

With the baths as described in FIGS. 6 and 7, one is able to select the direction of the massage: For instance, towards the heart, when it is desired.

In a particular embodiment, the wall having the longitudinal opening is inclined to receive the back of a person, and the inclined wall of the bath, defines a lounge-chair having a seating place with an inclined back, and a longitudinal median, and symmetrically disposed about said longitudinal median, said longitudinal opening is extending on each side of said median, said sets is obtained from a plurality of fluid injectors equally and symmetrically disposed about said median, in two rows, each row being parallel to said median and short thereof, and the injectors of each row are spaced equally so that one row is a mirror image of the other, for the injectors of one row and the corresponding injectors of the other row forming together, a set which is a pair, delivering each said fluid jet to preferentially hit on each side of said median, adjacent thereto, but short thereof, the injectors being operatively connected sequentially in consecutive order, in order to obtain said means to displace said trajectory from a fluid jet and thus said straight line of uniformly impinging points, and said inclined wall cooperating in shortening the height of said bath.

In a preferred embodiment, the space between the rows, such as 300 and 302, 200 and 202, or between injectors 42 and 44, or 142 and 144, is 4.5±1 inch.

It should be borne in mind that although in the above drawings particular reference was made to jets from injectors positioned to a particular side wall, these jets from injectors may be positioned as desired, on any side or along the bottom of the bath.

Also as shown from the drawings, the motors, such as 60, 166, 252, 352, are always outside the housings for security sake as well as the valves, such 230–236.

Also the components inside the housings are preferably plastic-made for their resistance to corrosion, their long lasting life, their electrical resistance and low maintenance costs.

In a preferred embodiment, said points are uniformly impinging on said body portion, although if desired, impinging points of variable intensities may also be obtained.

As seen from the above, the invention is also directed to a method, in a bath selected from the group consisting of whirlpool and therapeutic baths, which comprises:

in a bath having walls defining a bottom and sides upwardly extending therefrom, each of said walls having an inner surface and an outer surface, and said walls cooperating to define a receptacle for water and at least one person, a longitudinal opening in one of said walls, in order to communicate between the inner surface and the outer surface of one of said walls, said opening being defined by longitudinal sides, said longitudinal sides extending from one end to an opposite end, and fluid injectors equally and symmetrically disposed about a median, in two rows, each row being parallel to said median, adjacent to, but short thereof, and parallel to said wall having said longitudinal opening, with said fluid injectors producing uniform fluid jets on each of said two rows, each jet having a uniform trajectory, displacing said trajectory from said fluid jets, along two straight lines running across said trajectory, while maintaining spacing between said lines within 4.5±1 inches, in order to obtain a path of uniform impinging points in two substantially straight lines on a human body portion, and continuously repeating said displacement in said two straight lines.

Although emphasis has been placed to water lines and air lines for fluid injectors, it should be borne in mind that when water alone, or air alone, or water in a water-air system is fed, it should generally be fed in the so called water lines from hose 70 or line 66*w* or lines 330, 332, 334, 336. When a water-air system is used with injectors having a venturi, then the air line is used. In other words the air line 68, or 368, or 66*al* is not always required.

EXAMPLE

In whirlpool baths as described in FIGS. 1–3, the length of the longitudinal opening 18*c* communicating between the inner surface and the outer surface of the walls, was ranging from 20 to 30 inches, and the space between the two jets was 4.5±1 inch. The water hose 68 had an inner diameter of about an inch, and an outer diameter of about 1¼ inch, and the air hose 70, an inner diameter of about half an inch, and an outer diameter of about ¾ inch. The water hose and the air hose were connected via a 360° rotatable fitting or coupler to an elbow opening sideways into one injector, but joining a line leading to the second injector.

Near the second injector the water line which was about an inch was reduced to about half an inch in diameter, for about an inch prior to reaching the second injector, thereby producing a pressure regulator.

While some of the preferred embodiments have been described herein above, it is to be understood that the invention is not to be construed as limited to these preferred embodiments, as many modifications and variations are possible within the spirit and scope of the appended claims.

I claim:

1. A bath comprising:

walls defining a bottom and sides upwardly extending therefrom, each of said walls having an inner surface and an outer surface, and said walls cooperating to define a receptacle for water and at least one person, a longitudinal opening in one of said walls, in order to communicate between the inner surface and the outer surface of one of said walls, said opening being defined by longitudinal sides, said longitudinal sides extending from one end to an opposite end, at least one pair of fluid injectors, each injector producing a fluid jet defining a trajectory in a straight line to impinge at a point, upon a portion of a human body, said injectors being mounted on a carriage, and defining at least one row, said row being across said longitudinal opening, said carriage being provided with a motorized means to mechanically reciprocate said carriage, for displacement of said carriage and thereby said injectors, and thus said trajectory from each fluid jet in a straight line, running across said trajectory, and along said longitudinal opening, from said one end to said opposite end of said longitudinal opening, for allowing impinging fluid from each of said injectors, via said longitudinal opening and towards said bath, in order to obtain a path of impinging points in a substantially straight line on said body portion, and to continuously repeat said displacement in a straight line, and a housing to confine said injectors, said carriage and partly said motorized means to mechanically reciprocate said carriage, said housing being behind said longitudinal opening and water-tight sealed to said outer surface of said walls, said carriage having opposite ends, said opposite ends of said carriage being substantially parallel to said longitudinal sides of said longitudinal opening, said opposite ends of said carriage being slidably mounted into said housing, for reciprocating said fluid injectors along said longitudinal opening, whereby each of said injectors delivers one fluid jet which is repeatedly continuously displaced as a straight line along said longitudinal opening to impinge upon said portion of a human body in said bath near said longitudinal opening.

2. The bath as defined in claim 1, which is a whirlpool bath, and said fluid injectors are delivering a water jet containing air.

3. The bath as defined in claim 1, wherein said fluid injectors are rotating about a fixed point, and delivering a jet of water-air mixture.

4. The bath as defined as defined in claim 1, wherein said carriage has mounted thereon a ring, said ring having mounted therein a projecting finger, a twin-helix crisscross screw rotatably mounted into said housing for rotating inside said ring and engaging said finger for mechanically reciprocating said carriage, said twin-helix crisscross screw having one end, said one end being, rotatably and water-tightly, mounted to a motor in order to obtain a motorized twin-helix, said motor being outside said housing, whereby said carriage is motor driven by said twin-helix crisscross screw, along said longitudinal opening in one direction with one of said helices and contrary thereto by the other helix, and thus said motorized twin-helix, with said ring and projecting finger, are said motorized means to mechanically reciprocate said carriage.

5. The bath as defined in claim 1, wherein said longitudinal opening has a longitudinal median, and said carriage is driven along said longitudinal median.

6. The bath as defined as defined in claim 1, wherein said motorized means to mechanically reciprocate said carriage having at least one pair of injectors, is a motorized endless chain turning about two pulleys, one of said pulleys being rotatably mounted onto said housing, near one end of said longitudinal opening, and the other pulley being rotatably mounted onto said housing, near the opposite end of said longitudinal opening, one of said pulleys having a shaft, said shaft extending outwardly of said housing, via a water-tight sealing arrangement, and being rotatably mounted to a motor, in order to have a motorized endless chain, said endless chain having a tongue, and said carriage having opposite ends adjacent to said housing, being provided with a slot running across said endless chain for continuous engagement with said tongue, whereby said endless chain drive said carriage in one direction and contrary thereto upon turning about one of said two pulleys and thus said pulleys, said endless chain, said tongue, said motor, and said shaft being said motorized means to mechanically reciprocate said carriage and thereby said fluid injectors.

7. The bath as defined in claim 1, wherein said at least one pair of fluid injectors is a pair of fluid injectors, one of said injectors is disposed near one of said opposite ends of said carriage, and the other injector near the other of said opposite ends of said carriage.

8. The bath as defined in claim 1, wherein said longitudinal opening has a longitudinal median, and said carriage is driven along said longitudinal median, and said injectors on said carriage are symmetrically disposed with respect to said longitudinal median, adjacent thereto, but spaced therefrom.

9. The bath as defined in claim 1, having only two fluid injectors, said injectors delivering a water jet containing air, said water being pumped into said injectors, via a flexible hose, and air to be fed into said injectors via another flexible hose, said hoses having one end and another end, said hoses running along one longitudinal side of the longitudinal opening, from one end to the opposite end of the longitudinal opening, one of the ends of these hoses linking the injectors, being rotanably mounted adjacent to the other longitudinal side of the longitudinal opening, in order to obtain a 360° rotation hose-injector coupling, and for these hoses to define a curve between said hose-injector coupling, and said one longitudinal side of the longitudinal opening, and the other ends of these hoses being fixedly mounted adjacent to said opposite end of said longitudinal opening, and superimposed and fixedly held together near said other ends of these hoses, for a distance of about half the length of the longitudinal opening.

10. The bath as defined in claim 9, which includes a pressure regulator between the two fluid injectors.

11. The bath as defined as defined in claim 1, wherein said wall of the bath having a longitudinal opening, is an inclined wall, and said inclined wall of the bath, defines a lounge-chair having a seating place with an inclined back, and a longitudinal median, and symmetrically disposed about said longitudinal median, said longitudinal opening extending on each side of said median, along said inclined wall of the bath, each injector of said one pair of fluid injectors, being symmetrically disposed about said longitudinal median, one on each side of said median, and said carriage displacing said fluid jet on each side of said median, substantially parallel to said median and to said inclined wall, for said fluid jets to preferentially hit on each side of said median, adjacent thereto, but short thereof, said inclined wall cooperating in shortening the height of said bath.

12. The bath as defined as defined in claim 1, wherein said path has impinging points which are substantially uniform.

* * * * *